US007201128B2

(12) United States Patent
Freisinger

(10) Patent No.: US 7,201,128 B2
(45) Date of Patent: Apr. 10, 2007

(54) FUEL SUPPLY SYSTEM FOR INTERNAL COMBUSTION ENGINE WITH DIRECT FUEL INJECTION

(75) Inventor: Normann Freisinger, Lorch (DE)

(73) Assignee: DaimlerChrysler AG, Stuttgart (DE)

( * ) Notice: Subject to any disclaimer, the term of this patent is extended or adjusted under 35 U.S.C. 154(b) by 133 days.

(21) Appl. No.: 11/159,090

(22) Filed: Jun. 22, 2005

(65) Prior Publication Data

US 2005/0235962 A1 Oct. 27, 2005

Related U.S. Application Data

(63) Continuation-in-part of application No. PCT/EP03/13069, filed on Nov. 21, 2003.

(30) Foreign Application Priority Data

Dec. 23, 2002 (DE) ..... 102 60 775

(51) Int. Cl.
*F02D 41/06* (2006.01)

(52) U.S. Cl. ..... 123/179.17; 123/456

(58) Field of Classification Search ..... 123/179.17, 123/456, 446, 514, 447, 467
See application file for complete search history.

(56) References Cited

U.S. PATENT DOCUMENTS 5,598,817 A * 2/1997 Igarashi et al. ..... 123/179.17
6,073,597 A * 6/2000 Harata et al. ..... 123/179.14
6,234,128 B1 * 5/2001 Reuss ..... 123/179.17
6,267,104 B1 * 7/2001 Monnier ..... 123/516
6,497,215 B1 * 12/2002 Gaessler et al. ..... 123/447
6,520,156 B2 * 2/2003 Kojima ..... 123/456
6,659,085 B2 * 12/2003 Kojima ..... 123/456
6,769,414 B2 * 8/2004 Rembold et al. ..... 123/514

FOREIGN PATENT DOCUMENTS

| | | |
|---|---|---|
| DE | 38 33 430 | 7/1994 |
| DE | 43 13 852 | 11/1994 |
| DE | 197 53 155 | 11/1997 |
| DE | 198 48 991 | 5/1999 |
| DE | 199 49 514 | 4/2001 |
| DE | 199 52 782 | 5/2001 |
| GB | 2 308 157 | 6/1997 |
| WO | WO 99/28620 | 6/1999 |
| WO | WO 01/14713 | 3/2001 |
| WO | WO 01/52916 | 7/2001 |

* cited by examiner

*Primary Examiner*—Carl S. Miller
(74) *Attorney, Agent, or Firm*—Klaus J. Bach

(57) ABSTRACT

In a fuel supply system for an internal combustion engine with direct fuel injection including a fuel supply pump and, downstream thereof, a high pressure pump for supplying high pressure fuel to a plurality of injectors and, parallel to the high pressure fuel pump, a hydraulic transmission operated by the low pressure fuel of the fuel supply pump for generating initially high pressure fuel to the fuel injectors so as to permit instant engine startup upon actuation of a valve disposed in the fuel supply line from the fuel supply pump to the hydraulic transmission.

14 Claims, 2 Drawing Sheets

FUEL SUPPLY SYSTEM FOR INTERNAL COMBUSTION ENGINE WITH DIRECT FUEL INJECTION

This is a Continuation-In-Part Application of International Application PCT/EP03/13069 filed Nov. 21, 2003 and claiming the priority of German application 102 60 775.3 filed Dec. 23, 2002.

BACKGROUND OF THE INVENTION

The invention relates to a fuel supply system for an internal combustion engine with direct fuel injection including a fuel supply pump and downstream thereof a high pressure pump for supplying the fuel to a plurality of injectors and, parallel to the high pressure pump, a hydraulic transmission for providing in the start up phase an increased fuel pressure.

Internal combustion engine with direct fuel injection require already during startup high fuel injection pressures in order to achieve a mixture of the fuel with the combustion air sufficient for ignition of the mixture. The minimum pressure of the fuel for gasoline engines with direct fuel injection is about 50 bar and for diesel engines with direct fuel injection it is about 120 bar.

The fuel supply pumps known from the state of the art cannot provide the necessary fuel injection pressure. The necessary pressure is generally provided by a high pressure pump mounted to the camshaft and is available after about one turn of the camshaft that is two turns of the crankshaft.

Before reaching the above minimum fuel pressure, engines with direct fuel injection cannot start properly. This results in relatively long start up times and detrimentally affects particularly start/stop operation of the engine. In order to provide the minimum fuel pressure early on, the use of pressurized fuel storage arrangements or electrically operated high pressure pumps is known in the art.

DE 38 33 430 A1, for example, discloses a fuel supply system for internal combustion engines with a fuel pump driven by the internal combustion engine and a fuel supply pump in the form of a hydraulic pump which is operated by fuel returned from the engine-driven fuel pump. In the lines interconnecting the fuel pump and the hydraulic pump a pressure storage device with a compensation chamber is arranged. The fuel supply from the hydraulic pump to the pressure storage device is controlled by a valve which is opened when the compensation chamber of the pressure storage device is empty and remains open as long as fuel can flow into the pressure storage device. The fuel returned by way of the pressure line is directed into a chamber of the pressure storage device disposed between the valve and the hydraulic pump or, respectively, the pressure line.

However, with this arrangement, the formation of gas bubbles in the suction line of the hydraulic fuel pump (HDP) cannot safely be avoided. Also, the use of an electric fuel supply or high pressure pump has the disadvantage that these pumps are very expensive and subject to failure, that, in order to provide the necessary fuel pressure, they must be relatively large and that such pumps generate certain noises.

DE 199 52 782 A1 discloses a system for reducing the aerosol contained in the liquid fuel in a fuel storage device. An internal combustion engine operating with the common rail fuel injection principle includes—besides the rail and a plurality of injectors—a fuel storage unit which is connected, via a communication line, to a fuel filter, a fuel supply pump and a high pressure pump.

WO 99/28620 discloses a fuel supply system for internal combustion engines with direct fuel injection including a fuel supply pump and a downstream high pressure pump for supplying fuel via a pipe system from a fuel tank to a plurality of injectors or injection nozzles disposed downstream of the high pressure pump wherein between the fuel supply pump and the plurality of injectors or injection nozzles a hydraulic transmission is provided in parallel with the high pressure pump. The hydraulic transmission is designed for the generation and maintenance of a high fuel pressure in the startup and shut down phases of the internal combustion engine. The fuel supply pump is connected at its inlet side to the fuel tank and with its outlet to the hydraulic transmission and the supply pump is connected by way of a branch line to the high pressure pump.

It is the object of the present invention to provide a fuel supply system for internal combustion engines with direct fuel injection with which a fuel pressure as required for fuel injection can be maintained in the startup and shutdown phases of the internal combustion engine in a particularly simple manner.

SUMMARY OF THE INVENTION

In a fuel supply system for an internal combustion engine with direct fuel injection including a fuel supply pump and, downstream thereof, a high pressure pump for supplying high pressure fuel to a plurality of injectors and, parallel to the high pressure fuel pump, a hydraulic transmission operated by the low pressure fuel of the fuel supply pump for generating initially high pressure fuel to the fuel injectors so as to permit instant engine startup upon actuation of a valve disposed in the fuel supply line from the fuel supply pump to the hydraulic transmission.

With the system according to the invention, an electrically controllable high pressure pump is not needed in order to provide a high fuel injection peak pressure early on. The pumping volume of the supply pump also called EFP (electrical fuel pump) is so designed that sufficient fuel is supplied to the internal combustion engine at full engine load and high engine speed. Since at startup only a fraction of the pumped fuel volume is needed, the fuel pressure needed during startup can be generated by a normal fuel supply pump and a pressure increase stage which will be called below a hydraulic transmission. After the engine has started, the high pressure pump (HPP) provides for the high pressure needed at engine start-up. It is advantageous in this connection that there is no problem with gas bubbles in the suction line nor with a non-uniform fuel supply to the engine cylinders.

Furthermore, the whole system can be provided at relatively low costs when compared with conventional systems. With the method according to the invention, which does not require an electrical high pressure fuel pump, a higher energetic overall efficiency can be achieved than with the use of an electric high pressure fuel pump.

In accordance with the invention, the connecting line between the outlet of the fuel supply pump and the hydraulic transmission is provided upstream of the branch-off line with a first control valve. The hydraulic transmission is arranged between the fuel supply pump and the plurality of injectors or injection nozzles in parallel with the high pressure fuel pump and is capable of generating the high fuel pressure required for the injection during start-up of the internal combustion engine. By the method according to the invention, for the start-up of internal combustion engines with direct fuel injection, the high fuel pressure required can be generated or maintained in the standstill or start up phase of the engine. This advantageously results in a reduction of the startup time required for the engine. The invention therefore provides for an extremely advantageous rapid or instant start of the internal combustion engine.

The procedural step required therefor will be described below in greater detail with reference to the accompanying drawings.

DESCRIPTION OF THE PREFERRED EMBODIMENTS

Figure 1:
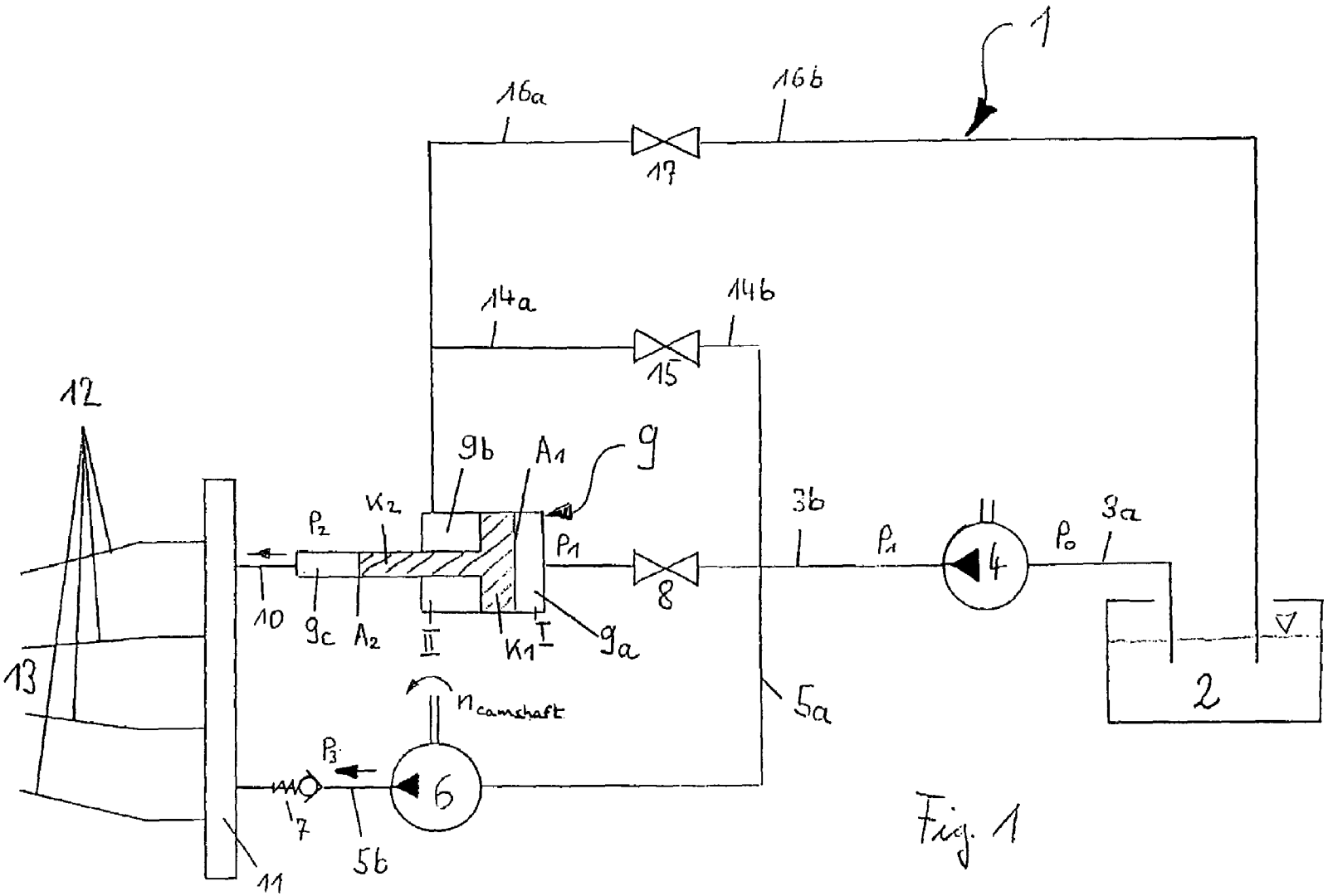
FIG. 1 shows a preferred embodiment of the fuel supply system according to the invention.

The fuel supply system 1 shown in FIG. 1 comprises a fuel tank 2, which is in communication with a low pressure fuel supply pump 4, a hydraulic transmission 9, which is a pressure increasing device and a high-pressure pump 6. The fuel supply pump 4 is connected with its inlet side to the fuel tank 2 by a line 3*a* and with its outlet side, by way of the line 3*b*, to the hydraulic transmission 9 and also, via a branch line 5*a*, to the high pressure pump 6.

FIG. 1 further shows a high pressure rail 11 by way of which the injectors 13 or injection nozzles are connected in parallel. The high pressure pump is connected to the high pressure rail by way of a line 5*b* and the hydraulic transmission 9 is connected to the high pressure rail via a line 10. In the connecting line 5*b* of the high pressure pump 6 to the high pressure rail 11, a check valve 7 is preferably arranged.

The connecting line 3*b* between the outlet of the fuel supply pump 4 and the hydraulic transmission 9 includes downstream of the branch-off of the branch line 5*a*, a first control valve 8. A second control valve 15 arranged in a branch line 14*a*, 14*b* which extends between a chamber 9*b* of the hydraulic transmission 9 and the connecting line 3*b* between the fuel supply pump 4 and the hydraulic transmission 9. A third control valve 17 is provided in a return line 16*a*, 16*b* extending from the chamber 9*b* of the hydraulic transmission 9 and the fuel tank 2.

The fuel flow between the fuel supply pump 4 and the hydraulic transmission 9 is controlled by the first control valve 8. By way of the line 14*a*, 14*b* and the second control valve 15, fuel can be supplied from the outlet side of the fuel supply pump 4 to the chamber 9*b*. Furthermore, fuel can be returned from the chamber 9*b* of the hydraulic transmission 9 to the fuel tank 2 via the return line 16*a*, 16*b* and the third control valve 17.

Immediately before the start of the internal combustion engine, the fuel injection pressure $p_2$ required for the startup of the engine is generated by way of the hydraulic transmission 9. To this end, the first and the third control valve 8, 17 are opened and the second control valve 15 is closed. The fuel supply pump 4 supplies fuel via the open valve 8 to the operating chamber 9*a* of the hydraulic transmission 9. The fuel pressure $p_1$ generated by the fuel supply pump 4 is effective on the piston K1 of the hydraulic transmission 9, which piston delimits the low pressure chamber 9*a* with a certain piston surface area A1 and moves the piston K1 from the position I to the position II. The pressure force generated on the piston K1 acts on a second piston K2 which is connected to the first piston K1 and which delimits the high pressure chamber 9*c* with a certain piston surface area A2. The pressure $p_2$ then generated by the piston K2 is increased over the pressure $p_1$ by the ratio A1/A2. In this startup phase, the high pressure pump 6 is not yet in operation. The high pressure chamber 9*c* is in communication with the high pressure rail 11 by a high pressure connecting line 10. When the fuel pressure needed for ignition is generated in this way, the engine can be started instantly. During the startup phase, in which the fuel supply pump 4 continues to operate, the high pressure pump 6 which is driven by the camshaft of the engine and which therefore is driven mechanically generates a fuel pressure $p_3$. The pressure $p_3$ developing at the outlet side of the high pressure pump 6 is transmitted to the high pressure rail 11 and, via the connecting line 10 to the high pressure chamber 9*c*. when the pressure $p_3$ generated by the high pressure pump 6 exceeds the hydraulic pressure $p_2$ generated by the hydraulic transmission 9, the piston K1 is moved back from the position II to the position I, that is, to its original position while the third control valve 17 is closed and the first and second control valves 8, 15 are opened.

During normal operation of the internal combustion engine, wherein the fuel pumps 4 and 6 provide for the fuel supply to the engine all three control valves 8, 15, 17 are closed.

Figure 2:
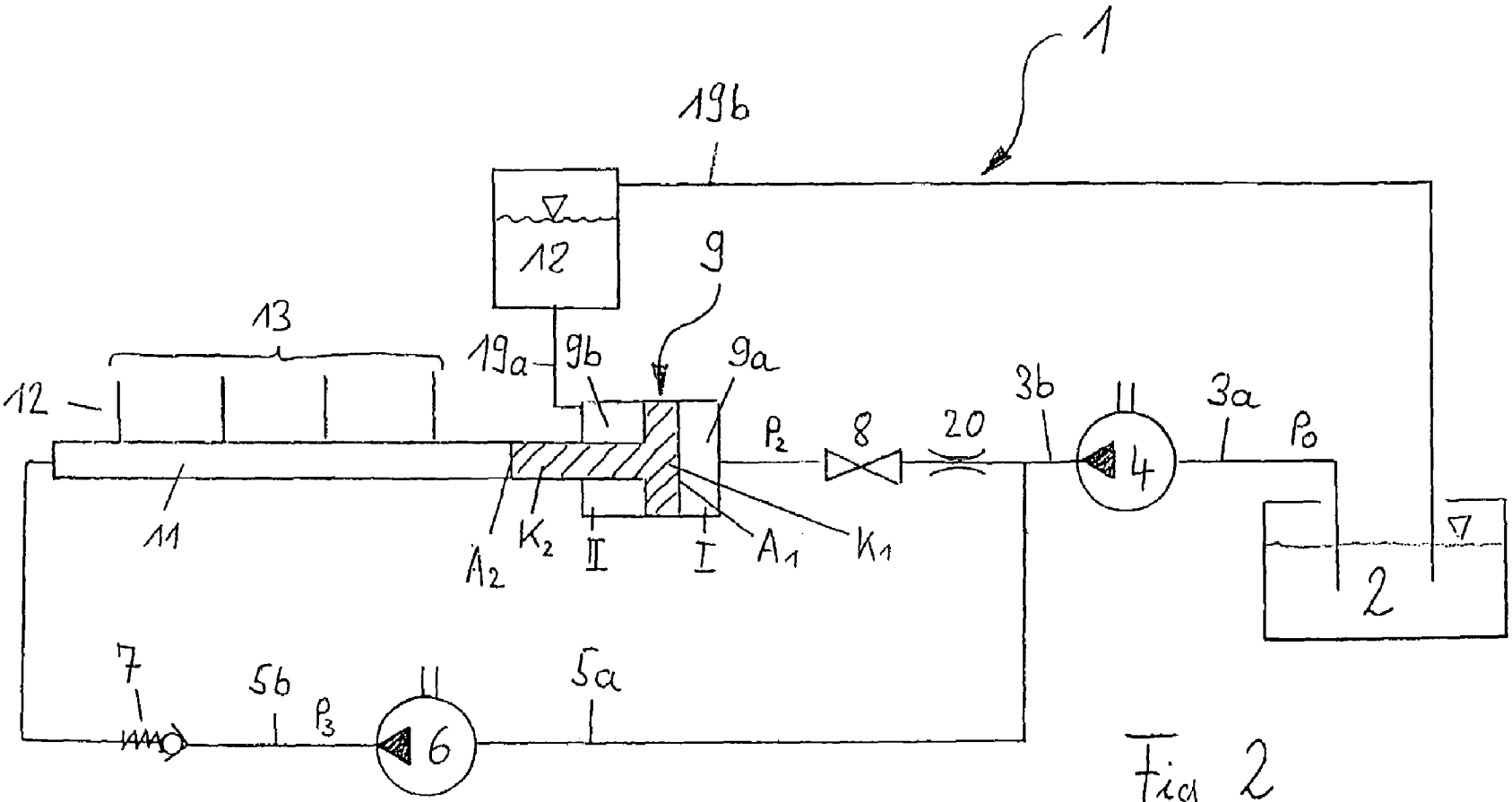
FIG. 2 shows another preferred embodiment of the fuel supply system according to the invention.

FIG. 2 shows another embodiment of the fuel supply system according to the invention, wherein for functionally identical components the same reference numerals are used as in FIG. 1, so that their operation is apparent from the description of FIG. 1. The fuel supply system of FIG. 2 differs from that of FIG. 1 in that the hydraulic transmission 9 is integrated into the high pressure rail 11. Furthermore, a compensation container 18 is connected via a line 19*a* with the chamber 9*b* of the hydraulic transmission 9 and by a return line 19*b* with the fuel tank 2. The compensation container 18 can contain excess fuel which, for example, by leakage enters the chamber 9*b* of the hydraulic transmission 9 and when necessary, return it to the fuel tank 2 via the return line 19*b*. Furthermore, a throttle 20 may be disposed in the connecting line 3*b* extending from the fuel supply pump 4 to the hydraulic transmission 9 downstream of the connection of the branch line 5*a* and ahead of the control valve 8.

The transmission ratio of the hydraulic transmission is so selected that, during normal operation of the internal combustion engine, the piston K1, K2 is always returned from the position II to the position I, that is, during operation the pressure $p_3$ after the high pressure pump 6 is higher than the pressure $p_2$ generated by the hydraulic transmission wherein $p_2 = p_1 x$ (hydraulic transmission ratio). In order to prevent that during the return movement of the piston K1, K2 a pressure drop occurs in the high pressure rail 11 which would result in a drop in the engine power output the return movement of the piston can be adapted to the requirements of the internal combustion engine by means of a throttle 20, which slows the return movement of the piston K1, K2.

The same effect however could be achieved by the control valve 8. In the startup phase, the control valve 8 is opened, so that the piston K1, K2 is moved from the position I to the position II. When the engine is operating the pressure $p_3$, which is generated by the high pressure pump 6 is higher than the pressure $p_2$ which is generated by the hydraulic transmission so that the piston K1, K2 is moved from the position II to the position I. In order to prevent a pressure drop at the high pressure rail 11, the control valve 8 is then closed. Also, in this case, the procedure can be slowed down by the throttle 20.

What is claimed is:

1. A fuel supply system (1) for an internal combustion engine with direct fuel injection comprising a fuel supply pump (4) and, downstream thereof, a high pressure fuel pump (6) for supplying fuel from a fuel tank (2) to a plurality of fuel injectors (13) of the internal combustion engine, and parallel to the high pressure pump (6) a hydraulic transmission (9) for providing, in the start up phase of the internal combustion engine, a fuel pressure to the fuel injectors sufficient for engine start up by the fuel supply pump (4), said fuel supply pump (4) being connected at its inlet side to a fuel tank (2) via an intake line (3*a*) and at its outlet side via a connecting line (3*b*) to the hydraulic transmission (9) and via a branch line (5*a*) to the high pressure pump (6), said connecting line (3*b*) between the fuel supply pump (4) and the hydraulic transmission (9) including, downstream of the connection of the branch line (5*a*), a first control valve (8).

2. A fuel supply system according to claim 1, wherein the connecting line (3*b*) between the outlet of the fuel supply pump (4) and the hydraulic transmission (9) includes downstream of the connection of the branch line (5*a*) and upstream of the control valve (8) a throttle (20).

3. A fuel supply system according to claim 1, wherein the fuel injectors (13) are connected, all in parallel, to a high pressure common rail (11) to which the high pressure fuel is supplied from the high pressure fuel pump (6) and the hydraulic transmission (9), and a check valve (7) is arranged in the branch line (5*a*, 5*b*) downstream of the high pressure pump (6) ahead of the common rail (11).

4. A fuel supply system according to claim 1, wherein a second control valve (15) is arranged in a communication line (14*a*, 14*b*) extending between a cylinder chamber (9*b*) of the hydraulic transmission (9) and the connecting line (3*b*) between the fuel supply pump (4) and the hydraulic transmission (9).

5. A fuel supply system according to claim 4, wherein a third control valve (17) is arranged in a return line (16*a*, 16*b*) extending from the cylinder chamber (9*b*) of the hydraulic transmission (9) to the fuel tank (2).

6. A fuel supply system according to claim 4, wherein a compensation container (18) is connected to the cylinder chamber (9*b*) of the hydraulic transmission (9) via a first return line section (19*a*) and to the fuel tank (2) via a second return line section (19*b*).

7. A fuel supply system according to claim 3, wherein the hydraulic transmission (9) is integrated into the high pressure common rail (11).

8. A method for starting and operating an internal combustion engine with direct fuel injection by means of a fuel supply system (1), comprising the steps of pumping fuel with a fuel supply pump (4) from a fuel tank (2) to a high pressure pump (6) which supplies the fuel under high pressure to a plurality of injectors, generating during an engine startup phase a fuel pressure as required for the injection into the internal combustion engine by a hydraulic transmission operated by pressure from the fuel supply pump, and controlling the fuel flow from the fuel supply pump (4) to the hydraulic transmission (9) by a first control valve (8) arranged in a fuel supply line to the hydraulic transmission (9).

9. A method according to claim 8, wherein the hydraulic transmission includes a cylinder with a piston K1, K2 having an operating chamber (9*a*) and a cylinder chamber (9*b*) which is connected to a connecting line (3*b*) between the fuel supply pump (2) and the hydraulic transmission (9) via a second control valve (15), and operating the second control valve for placing the operating chamber (9*a*) in communication with the fuel supply line from the fuel supply pump (2).

10. A method according to claim 9, wherein a return line (16*a*, 16*b*) extends from the cylinder chamber (9*b*) to the fuel tank (2) and includes a third control valve (17) and the third control valve (17) is operated for selectively placing the cylinder chamber (9*b*) in communication with the fuel tank (2).

11. A method according to claim 8, wherein immediately before the startup of the internal combustion engine, the fuel supply pump (2) is operated to actuate the hydraulic transmission which pressurizes the fuel in the fuel lines (12) to the fuel injectors (13) to a degree sufficient for engine startup and, in the process, the first and the second control valves (8, 17) are opened and the second control valve (15) is closed.

12. A method according to claim 11, wherein, after engine startup, when the high pressure pump (6) is operated and the fuel pressure generated by the high pressure pump (6) exceeds the pressure generated by the hydraulic transmission (9), the third control valve (17) is closed and the first and second control valves (8, 15) are opened while the piston (K1, K2) of the hydraulic transmission (9) is returned to its start out position.

13. A method according to claim 12, wherein during normal engine operation all three control valves (8, 15, 17) are closed.

14. A method according to claim 9, wherein a compensation container (18) is in communication with the cylinder chamber (9*b*) of the hydraulic transmission (9) for receiving therefrom fuel discharged during actuation of the hydraulic transmission (9) and storing the fuel for return to the chamber (9*b*) when the piston (K1, K2) of the hydraulic transmission returns to its original state after startup of the engine.

* * * * *